US007174812B1

(12) United States Patent
Chiang

(10) Patent No.: US 7,174,812 B1
(45) Date of Patent: Feb. 13, 2007

(54) DRIVING TOOL HAVING FASTENER RETAINING DEVICE

(75) Inventor: Wen Hung Chiang, Taichung Hsien (TW)

(73) Assignee: Hsin Ying Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 11/444,197

(22) Filed: May 31, 2006

(51) Int. Cl.
*B25B 23/08* (2006.01)

(52) U.S. Cl. ..... 81/125; 81/177.2; 81/451

(58) Field of Classification Search ..... 81/451–458, 81/436, 438, 442–445, 177.2, 125; 606/104, 606/151

See application file for complete search history.

(56) References Cited

U.S. PATENT DOCUMENTS

| | | | | | |
|---|---|---|---|---|---|
| 2,579,438 | A * | 12/1951 | Longfellow | ..... | 81/453 |
| 4,165,772 | A * | 8/1979 | Suga | ..... | 81/453 |
| 4,434,688 | A * | 3/1984 | Bowles | ..... | 81/451 |
| 4,455,898 | A * | 6/1984 | Marbourg, Jr. | ..... | 81/454 |
| 4,763,548 | A * | 8/1988 | Leibinger et al. | ..... | 81/453 |
| 5,667,513 | A * | 9/1997 | Torrie et al. | ..... | 606/104 |
| 5,724,873 | A | 3/1998 | Hillinger | ..... | 81/451 |
| 5,868,048 | A | 2/1999 | Cassutti et al. | ..... | 81/439 |
| 6,286,401 | B1 * | 9/2001 | Hajianpour | ..... | 81/453 |
| 6,363,819 | B1 * | 4/2002 | Li | ..... | 81/438 |
| 6,857,343 | B1 * | 2/2005 | Easterbrooks et al. | ..... | 81/452 |

* cited by examiner

*Primary Examiner*—Lee D. Wilson
*Assistant Examiner*—Anthony Ojini
(74) *Attorney, Agent, or Firm*—Charles E. Baxley

(57) ABSTRACT

A driving tool includes a driving shank having a handle for rotating the driving shank and having an engaging hole formed by two or more spring blades for receiving a fastener, and an actuating device for actuating the spring blades to move radially inward and to force and grasp the fastener to the driving shank, for preventing the fastener from being disengaged from the driving tool inadvertently. The actuating device may include a barrel slidably engaged onto the driving shank for moving the spring blades to grasp the fastener to the driving shank with such as an inclined engagement. A control ferrule may be used to move the barrel relative to the driving shank.

9 Claims, 6 Drawing Sheets

DRIVING TOOL HAVING FASTENER RETAINING DEVICE

BACKGROUND OF THE INVENTION

1. Field of the Invention

The present invention relates to a driving tool, and more particularly to a driving tool including a fastener retaining or clamping device for solidly attaching or coupling the fastener to the driving tool and for preventing the fastener from being disengaged from the driving tool.

2. Description of the Prior Art

Typical driving tools, such as wrenches, screw drivers comprise a driving shank having one end for engaging with a fastener to be rotated or driven by the driving shank, and thus for allowing the fastener to be suitably rotated or driven into various work pieces by the driving shank. However, normally, the users have to use one of their hands to hold the fastener, and the other hand to hold and operate the handle of typical driving tools, such that the users may not easily operate the typical driving tools to rotate or drive the fastener.

For allowing the fastener to be solidly attached or coupled to the driving shank, one or more magnetic devices or magnets have been provided and attached or coupled to the driving shank for attracting and attaching or coupling the fastener to the driving shank and for preventing the fastener from being disengaged from the driving tool.

For example, U.S. Pat. No. 5,724,873 to Hillinger, and U.S. Pat. No. 5,868,048 to Cassutti et al. disclose two of the typical driving tools each also comprising one or more magnetic devices or magnets attached or coupled to the driving shank for attracting or coupling the fastener to the driving shank. However, the fastener also may not be solidly attached or coupled to the driving shank by the magnetic devices or magnets and may also have a good chance to be disengaged from the driving tool when the fastener and/or the driving tool is contacted or hit by the other objects.

The present invention has arisen to mitigate and/or obviate the afore-described disadvantages of the conventional fastener holding or retaining problems for the driving tools.

SUMMARY OF THE INVENTION

The primary objective of the present invention is to provide a driving tool including a fastener retaining or clamping device for solidly attaching or coupling the fastener to the driving tool and for preventing the fastener from being disengaged from the driving tool inadvertently.

In accordance with one aspect of the invention, there is provided a driving tool comprising a driving shank including a handle provided on one end thereof for rotating the driving shank, and including an engaging hole formed in the other end thereof and defined by at least two spring blades for receiving a fastener, and an actuating device for actuating the spring blades to move radially inward and to force and grasp the fastener to the driving shank, and for preventing the fastener from being disengaged from the driving tool inadvertently.

The driving shank includes at least one slot formed therein for forming the spring blades. The actuating device includes a barrel slidably engaged onto the driving shank and provided for engaging with the spring blades and for moving the spring blades to grasp the fastener to the driving shank.

The driving shank includes an inclined member provided thereon, and the barrel includes an inclined element provided thereon for engaging with the inclined member of the driving shank and for forcing the spring blades to grasp the fastener to the driving shank.

The inclined member of the driving shank is formed on the spring blades. The actuating device includes a control ferrule movably engaged onto the driving shank and engageable with the barrel for moving the barrel relative to the driving shank.

The driving shank includes an outer thread provided thereon, and the control ferrule includes an inner thread provided thereon for engaging with the outer thread of the driving shank and for movably engaging the control ferrule to the driving shank.

Alternatively, the handle may include an outer thread provided thereon, and the control ferrule includes an inner thread provided thereon for engaging with the outer thread of the handle and for movably engaging the control ferrule to the handle and the driving shank.

Further alternatively, the handle includes an inner thread provided thereon, and the control ferrule includes an outer thread provided thereon for engaging with the inner thread of the handle and for movably engaging the control ferrule to the handle and the driving shank.

Further alternatively, the barrel includes a sleeve coupled thereto for engaging with the spring blades and for moving the spring blades to grasp the fastener to the driving shank. The driving shank includes an inclined member provided thereon, and the sleeve includes an inclined element provided thereon for engaging with the inclined member of the driving shank and for forcing the spring blades to grasp the fastener to the driving shank.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
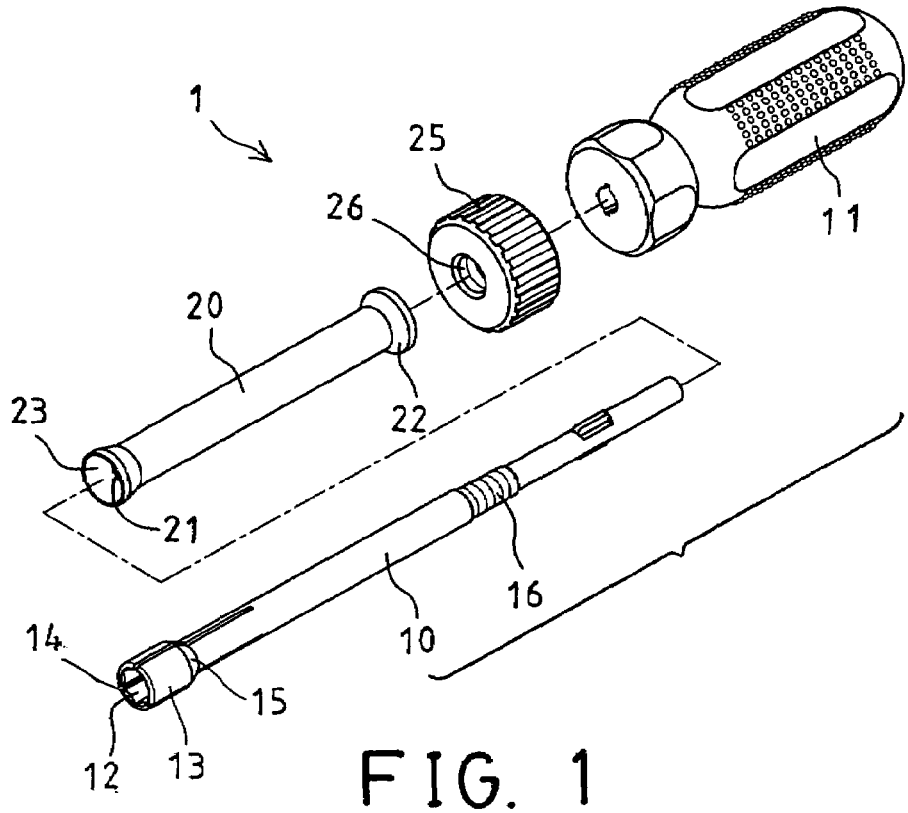
FIG. 1 is a partial exploded view of a driving tool in accordance with the present invention.
Figure 2:
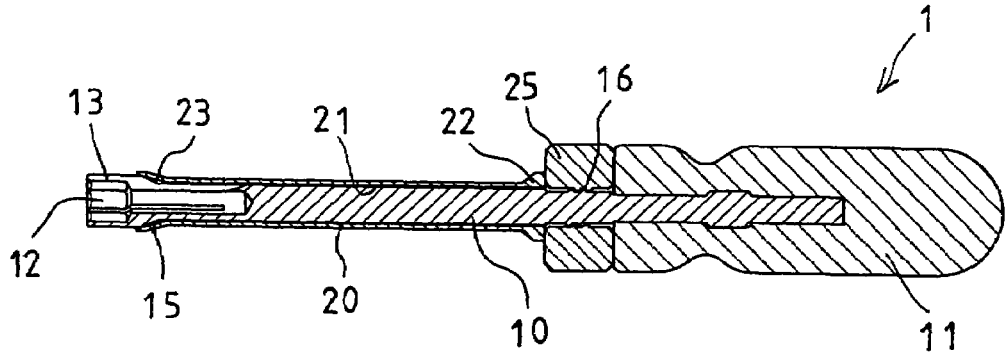
FIG. 2 is a cross sectional view of the driving tool.
Figure 3:
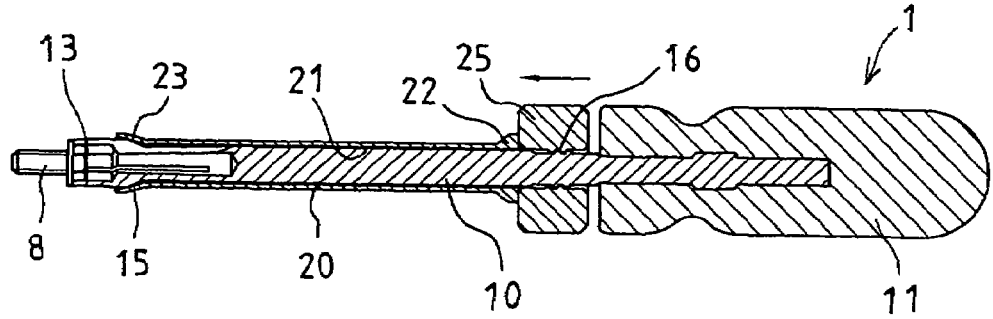
FIG. 3 is a cross sectional view similar to FIG. 2, illustrating the operation of the driving tool.

Referring to the drawings, and initially to FIGS. 1–2, a driving tool 1 in accordance with the present invention comprises a driving shank 10 having a handle 11 attached or coupled or provided or secured to one end thereof for rotating or driving or operating the driving shank 10, and having an engaging hole 12 formed in the other end thereof for receiving or engaging with a fastener 8 (FIG. 3), and defined by two or more spring blades 13 and/or one or more slots 14 that are formed between the spring blades 13. The driving shank 10 includes an inclined or cone-shaped member 15 formed thereon, such as formed on the spring blades 13, and an outer thread 16 formed thereon and spaced away from or located distal to the spring blades 13. The cone-shaped member 15 may be inclined or facing toward the outer thread 16.

A barrel 20 includes a bore 21 for slidably engaging onto the driving shank 10 and includes an enlarged head 22 formed or provided on one end thereof, and an inclined or cone-shaped element 23 formed or provided on the other end thereof for engaging with the corresponding inclined or cone-shaped member 15 of the driving shank 10 for moving or forcing the spring blades 13 to move radially inward or to move toward each other for solidly forcing and grasping the fastener 8 between the spring blades 13 and thus for solidly holding or retaining the fastener 8 to the driving shank 10. An actuating means or device 25, such as a control ferrule 25 may be movably engaged onto the driving shank 10 and has an inner thread 26 formed therein for threading with the outer thread 16 of the driving shank 10.

In operation, as shown in FIG. 2, when the inclined or cone-shaped element 23 of barrel 20 is moved or disengaged from the corresponding inclined or cone-shaped member 15 of the driving shank 10, the spring blades 13 of the driving shank 10 may be moved radially outward or moved away from each other for allowing the fastener 8 to be easily engaged into the engaging hole 12 of the driving shank 10. The spring blades 13 may then be moved radially inward or toward each other to solidly force and grasp the fastener 8 to the driving shank 10 with the spring blades 13 when the inclined or cone-shaped element 23 of barrel 20 is moved or forced onto the corresponding inclined or cone-shaped member 15 of the driving shank 10.

Figure 4:
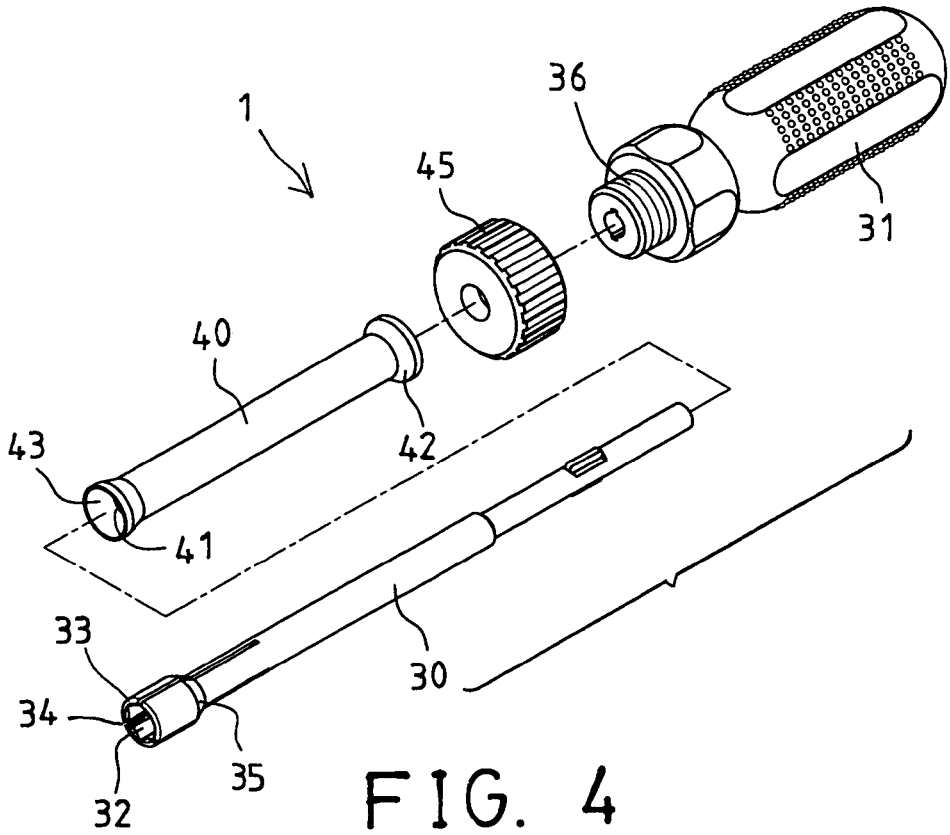
FIG. 4 is a partial exploded view illustrating the other arrangement of the driving tool.
Figure 5:
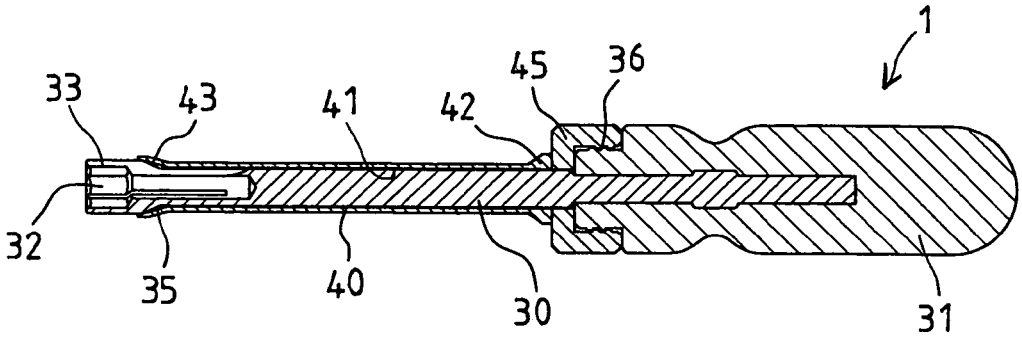
FIG. 5 is a cross sectional view of the driving tool as shown in FIG. 4.
Figure 6:
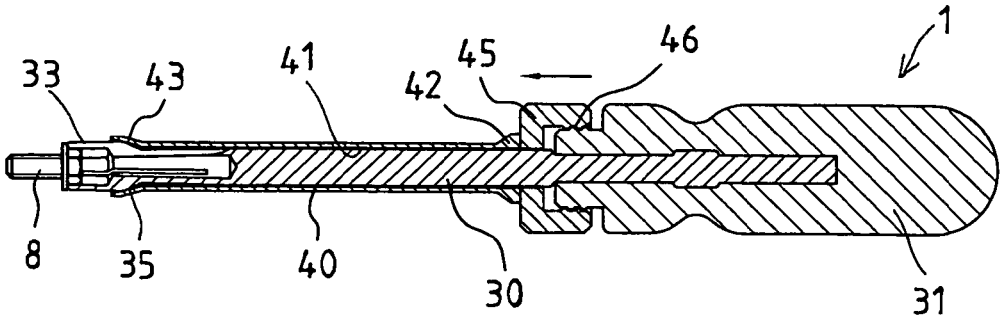
FIG. 6 is a cross sectional view similar to FIG. 5, illustrating the operation of the driving tool as shown in FIGS. 4, 5.

Alternatively, as shown in FIGS. 4–6, the driving tool 1 may also comprise a driving shank 30 having a handle 31 attached to one end thereof for rotating or driving the driving shank 30, and having an engaging hole 32 formed in the other end for engaging with a fastener 8 (FIG. 6), and defined by two or more spring blades 33 and/or one or more slots 34 that are formed between the spring blades 33. The driving shank 30 includes an inclined or cone-shaped member 35 formed on the spring blades 33. A barrel 40 includes a bore 41 for slidably engaged onto the driving shank 30 and includes an enlarged head 42 formed or provided on one end, and an inclined or cone-shaped element 43 on the other end for engaging with the corresponding inclined or cone-shaped member 35 of the driving shank 30 for moving or forcing the spring blades 33 to force and grasp the fastener 8 to the driving shank 30. An actuating means or device 45, such as a control ferrule 45 may be engaged onto the driving shank 30 and has an inner thread 46 (FIG. 6) for threading with the outer thread 36 of the handle 31.

Figure 7:
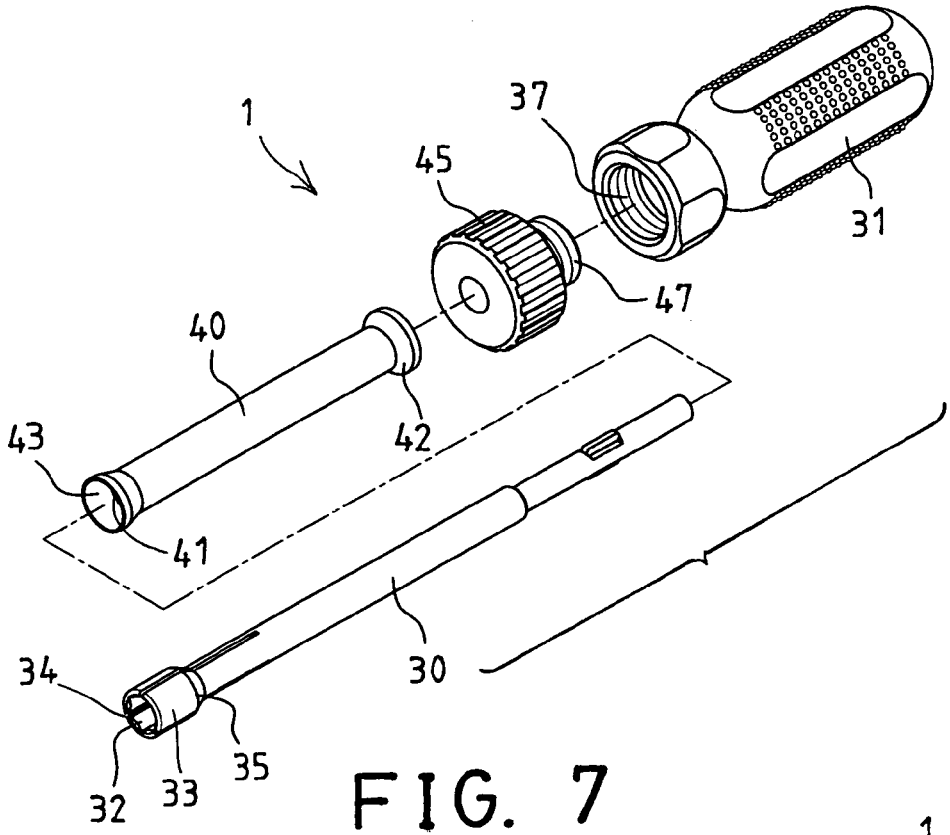
FIG. 7 is a partial exploded view illustrating the further arrangement of the driving tool.
Figure 8:
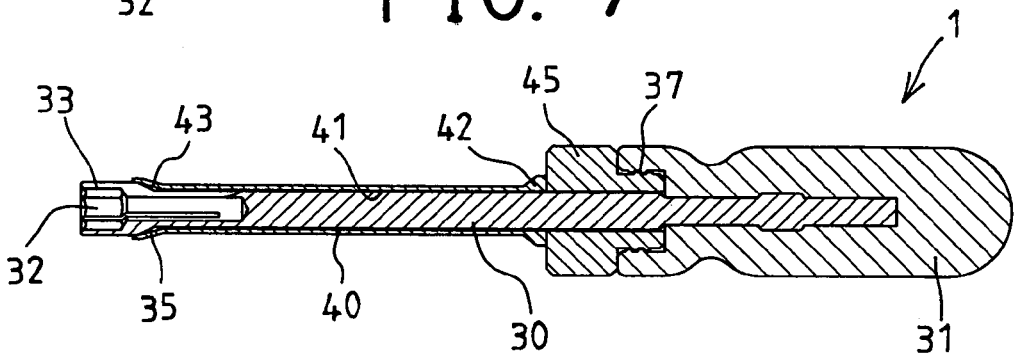
FIG. 8 is a cross sectional view of the driving tool as shown in FIG. 7.
Figure 9:
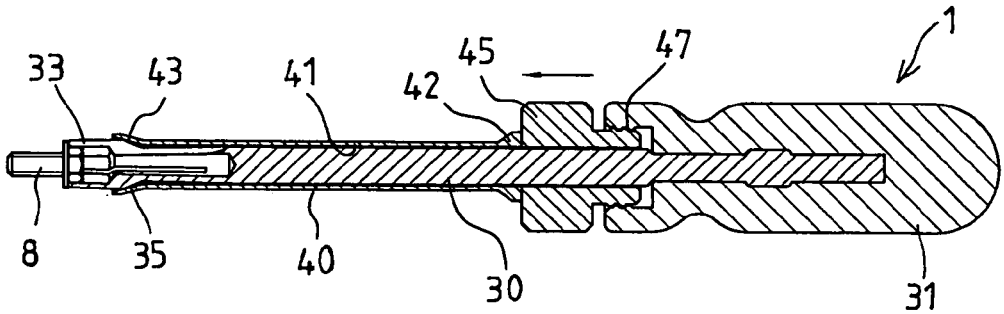
FIG. 9 is a cross sectional view similar to FIG. 8, illustrating the operation of the driving tool as shown in FIGS. 7, 8.

Further alternatively, as shown in FIGS. 7–9, the control ferrule 45 may also be engaged onto the driving shank 30 and has an outer thread 47 (FIGS. 7, 9) for threading with the inner thread 37 of the driving handle 31 and for moving or forcing the spring blades 33 to force and grasp the fastener 8 to the driving shank 30. The barrels 20, 40 and/or the inclined or cone-shaped element 23 of barrel 20 and the inclined or cone-shaped member 15 of the driving shank 10 and the control ferrules 25, 45 may thus be formed or acted as an actuating means or device 25, 45 for moving the spring blades 13 radially inward or toward each other to solidly force and grasp the fastener 8 to the driving shank 10.

Figure 10:
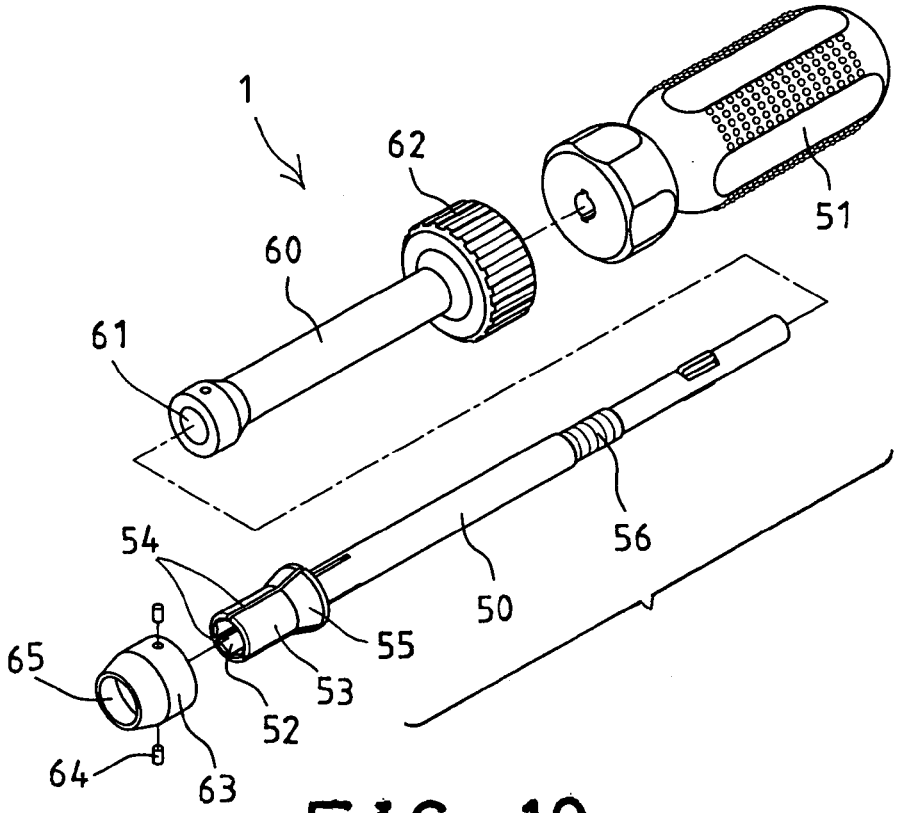
FIG. 10 is a partial exploded view illustrating the still further arrangement of the driving tool.
Figure 11:
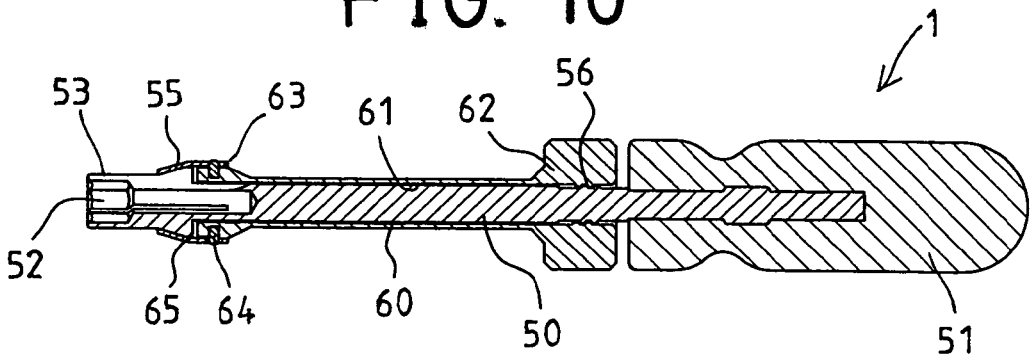
FIG. 11 is a cross sectional view of the driving tool as shown in FIG. 10.
Figure 12:
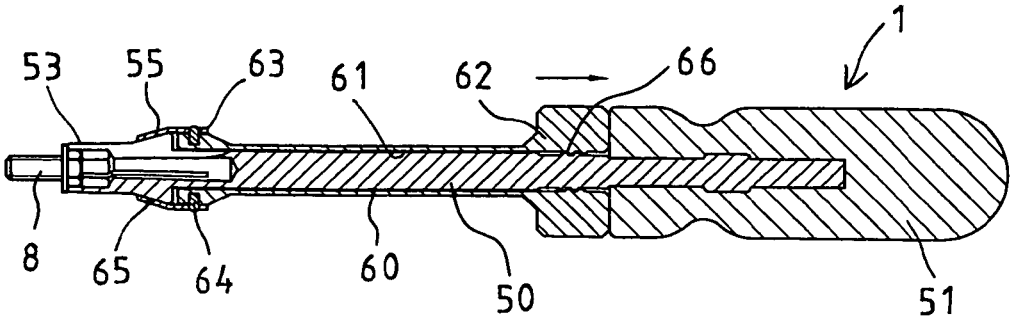
FIG. 12 is a cross sectional view similar to FIG. 11, illustrating the operation of the driving tool as shown in FIGS. 10, 11.

Further alternatively, as shown in FIGS. 10–12, the driving tool 1 may also comprise a driving shank 50 having a handle 51 attached to one end thereof for rotating or driving the driving shank 50, and having an engaging hole 52 formed in the other end for engaging with a fastener 8 (FIG. 12), and defined by two or more spring blades 53 and/or one or more slots 54 that are formed between the spring blades 53. The driving shank 50 includes an inclined or cone-shaped member 55 formed on the spring blades 53 and inclined or facing toward the outer thread 56. A barrel 60 includes a bore 61 for slidably engaged onto the driving shank 50 and includes an actuating means or device 62, such as a control ferrule 62 formed or provided on one end for rotating the barrel 60 relative to the driving shank 50.

A sleeve 63 may further be provided and engaged onto the outer or free end portion of the driving shank 50 and secured or coupled to the barrel 60 with one or more fasteners or pins 64, and includes an inclined or cone-shaped element 65 on the outer or free end portion for engaging with the corresponding inclined or cone-shaped member 55 of the driving shank 50 and for moving or forcing the spring blades 53 to force and grasp the fastener 8 to the driving shank 50. The control ferrule 62 may be engaged onto the driving shank 50 and has an inner thread 66 (FIG. 12) for threading with the outer thread 56 of the driving handle 51 and for moving the cone-shaped element 65 of the barrel 60 to engage with the cone-shaped member 55 of the driving shank 50.

Figure 13:
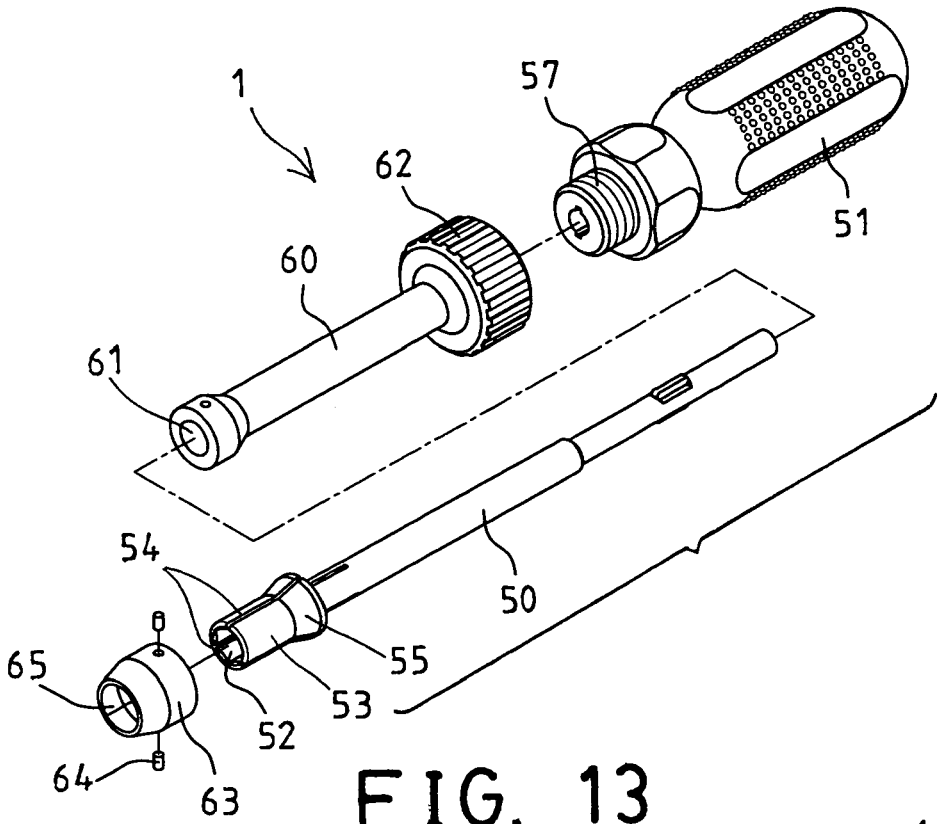
FIG. 13 is a partial exploded view illustrating the still further arrangement of the driving tool.
Figure 14:
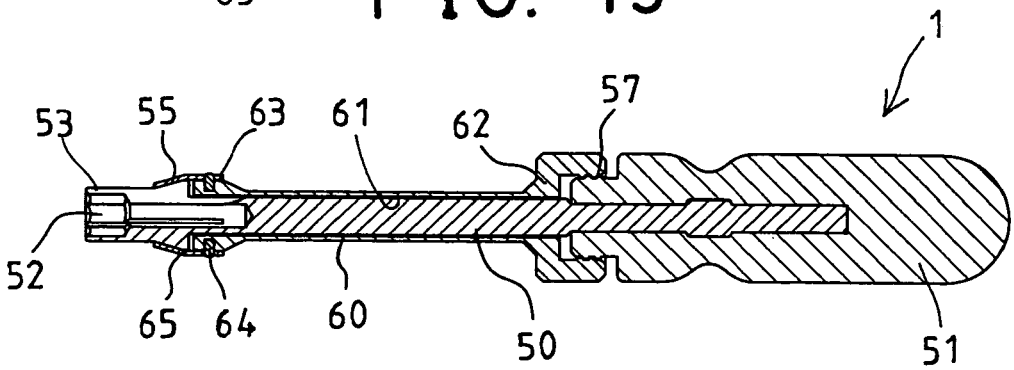
FIG. 14 is a cross sectional view of the driving tool as shown in FIG. 13.
Figure 15:
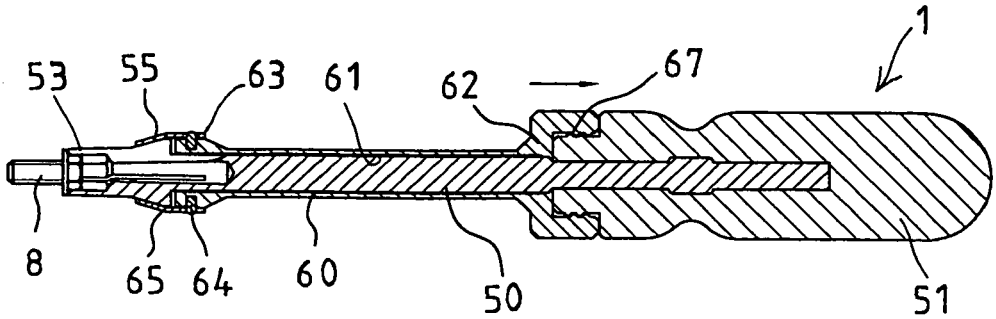
FIG. 15 is a cross sectional view similar to FIG. 14, illustrating the operation of the driving tool as shown in FIGS. 13, 14.
Figure 16:
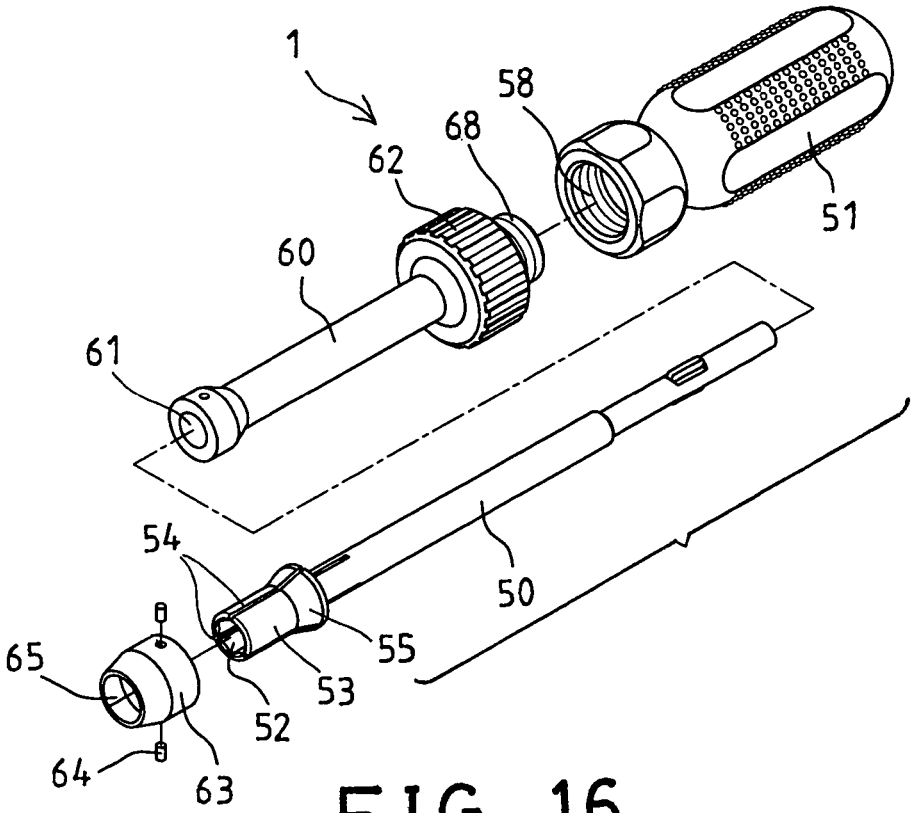
FIG. 16 is a partial exploded view illustrating the still further arrangement of the driving tool.
Figure 17:
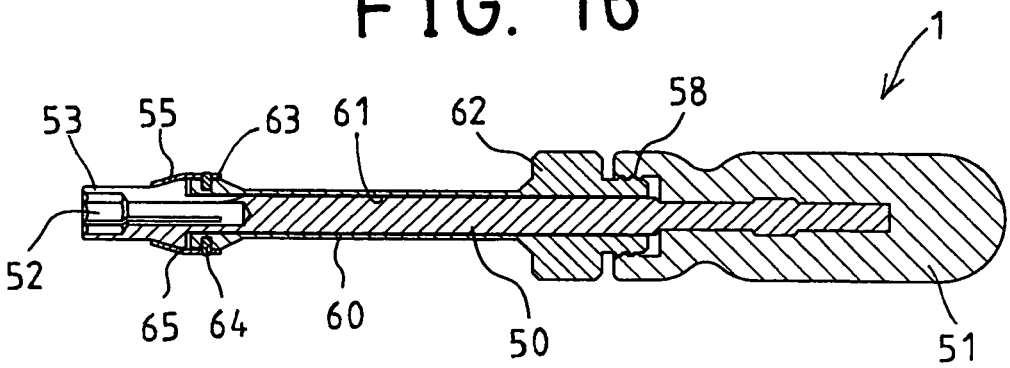
FIG. 17 is a cross sectional view of the driving tool as shown in FIG. 16.
Figure 18:
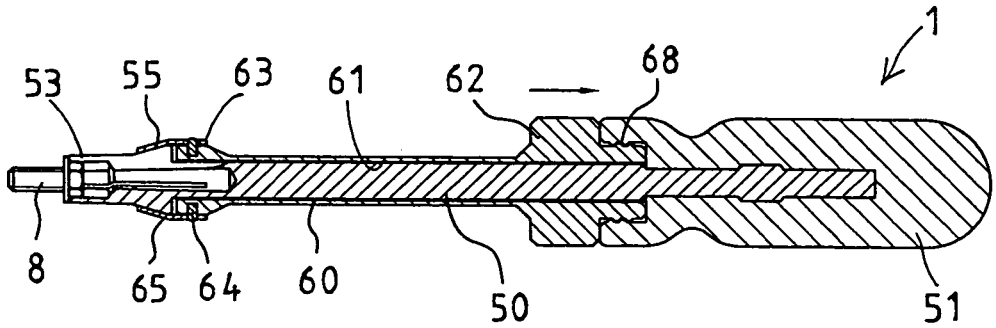
FIG. 18 is a cross sectional view similar to FIG. 17, illustrating the operation of the driving tool as shown in FIGS. 16, 17.

Further alternatively, as shown in FIGS. 13–15, the actuating means or device or control ferrule 62 may include an inner thread 67 formed or provided on one end portion thereof (FIG. 15) for threading with an outer thread 57 of the driving handle 31 and for moving or forcing the cone-shaped element 65 of the barrel 60 to engage with the cone-shaped member 55 of the driving shank 50 and thus to force the spring blades 53 to force and grasp the fastener 8 to the driving shank 50. Further alternatively, as shown in FIGS. 16–18, the control ferrule 62 may also be engaged onto the driving shank 50 and has an outer thread 68 (FIGS. 16, 18) for threading with the inner thread 58 of the handle 51 and for moving or forcing the spring blades 53 to force and grasp the fastener 8 to the driving shank 50.

Accordingly, the driving tool in accordance with the present invention includes a fastener retaining or clamping device for solidly attaching or coupling the fastener to the driving tool and for preventing the fastener from being disengaged from the driving tool inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving tool comprising:

a driving shank including a handle provided on one end thereof for rotating said driving shank, and including an engaging hole formed in the other end thereof and defined by at least two spring blades for receiving a fastener, and means for actuating said at least two spring blades to move radially inward and to force and grasp the fastener to said driving shank, said actuating means including a barrel slidably engaged onto said driving shank and provided for engaging with said at least two spring blades and for moving said at least two spring blades to grasp the fastener to said driving shank, said barrel including a sleeve coupled thereto for engaging with said at least two spring blades and for moving said at least two spring blades to grasp the fastener to said driving shank.

2. The driving tool as claimed in claim 1, wherein said driving shank includes at least one slot formed therein for forming said at least two spring blades.

3. The driving tool as claimed in claim 1, wherein said driving shank includes an inclined member provided thereon, and said barrel includes an inclined element provided thereon for engaging with said inclined member of said driving shank and for forcing said at least two spring blades to grasp the fastener to said driving shank.

4. The driving tool as claimed in claim 3, wherein said inclined member of said driving shank is formed on said at least two spring blades.

5. The driving tool as claimed in claim 1, wherein said actuating means includes a control ferrule movably engaged onto said driving shank and engageable with said barrel for moving said barrel relative to said driving shank.

6. The driving tool as claimed in claim 5, wherein said driving shank includes an outer thread provided thereon, and said control ferrule includes an inner thread provided thereon for engaging with said outer thread of said driving shank and for movably engaging said control ferrule to said driving shank.

7. The driving tool as claimed in claim 5, wherein said handle includes an outer thread provided thereon, and said control ferrule includes an inner thread provided thereon for engaging with said outer thread of said handle and for movably engaging said control ferrule to said handle and said driving shank.

8. The driving tool as claimed in claim 5, wherein said handle includes an inner thread provided thereon, and said control ferrule includes an outer thread provided thereon for engaging with said inner thread of said handle and for movably engaging said control ferrule to said handle and said driving shank.

9. The driving tool as claimed in claim 1, wherein said driving shank includes an inclined member provided thereon, and said sleeve includes an inclined element provided thereon for engaging with said inclined member of said driving shank and for forcing said at least two spring blades to grasp the fastener to said driving shank.

* * * * *